US005243813A

United States Patent [19]

Stahlecker

[11] Patent Number: 5,243,813

[45] Date of Patent: * Sep. 14, 1993

[54] PROCESS AND AN ARRANGEMENT FOR FALSE-TWIST SPINNING

[75] Inventor: Fritz Stahlecker, Josef-Neidhart-Strasse 18, 7347 Bad Überkingen, Fed. Rep. of Germany

[73] Assignees: Fritz Stahlecker; Hans Stahlecker, Fed. Rep. of Germany

[ * ] Notice: The portion of the term of this patent subsequent to Feb. 25, 2009 has been disclaimed.

[21] Appl. No.: 824,887

[22] Filed: Jan. 22, 1992

Related U.S. Application Data

[63] Continuation of Ser. No. 588,075, Sep. 25, 1990, abandoned.

[30] Foreign Application Priority Data

Oct. 4, 1989 [DE] Fed. Rep. of Germany ..... 3933114

[51] Int. Cl.[5] ..... D02G 3/00; D01H 1/02

[52] U.S. Cl. ..... 57/328; 57/315; 57/333

[58] Field of Search ..... 57/90, 315, 328, 333, 57/401, 408

[56] References Cited

U.S. PATENT DOCUMENTS

| | | | |
|---|---|---|---|
| 3,487,619 | 1/1970 | Field | 264/290.5 X |
| 4,488,397 | 12/1984 | Venot | 57/287 X |
| 4,583,355 | 4/1986 | Vignon | 57/5 |
| 4,598,537 | 7/1986 | Kroupa et al. | 57/315 X |
| 4,858,420 | 8/1989 | Stahlecker et al. | 57/350 X |
| 4,953,349 | 9/1990 | Fehrer | 57/352 X |
| 5,090,192 | 2/1992 | Stahlecker | 57/90 X |

FOREIGN PATENT DOCUMENTS 3714212 11/1988 Fed. Rep. of Germany .

*Primary Examiner*—Stanley N. Gilreath
*Assistant Examiner*—William Stryjewski
*Attorney, Agent, or Firm*—Evenson, McKeown, Edwards & Lenahan

[57] ABSTRACT

In a process and arrangement for false-twist spinning, it is provided that, by use of an air current in the delivery area of a drafting unit, an increased number of fiber ends are spread away which subsequently, in a controlled manner, are wound around the sliver by means of a guiding element moving in the travelling direction of the sliver and holding the spread-away fiber ends.

37 Claims, 17 Drawing Sheets

FIG. 7
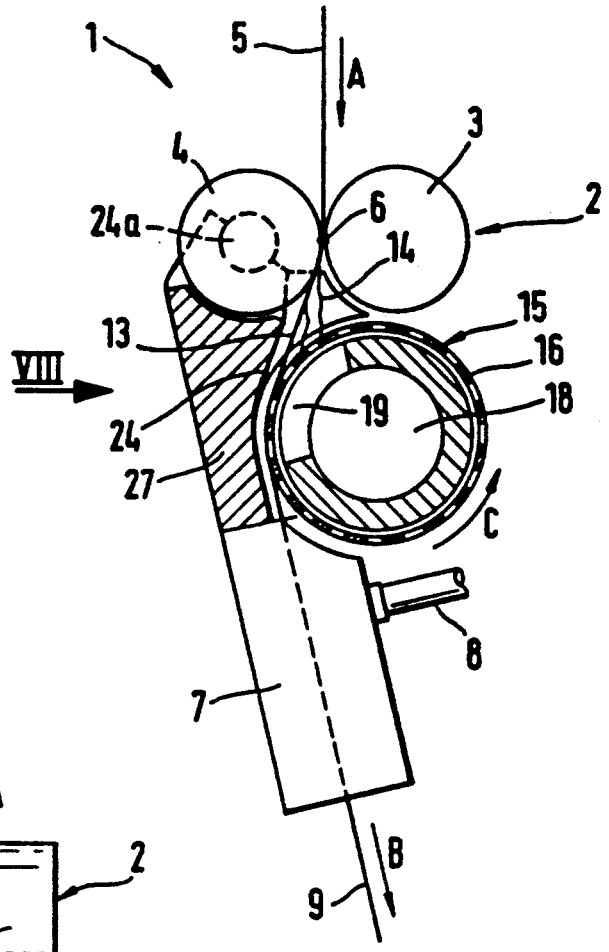
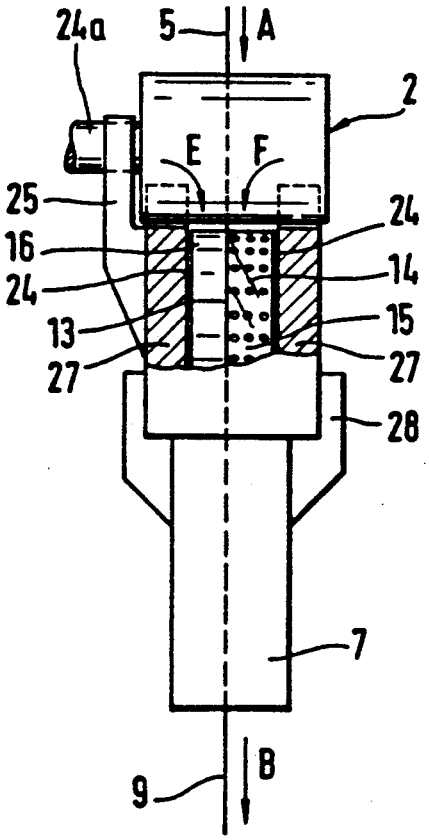
FIG. 8

PROCESS AND AN ARRANGEMENT FOR FALSE-TWIST SPINNING

This is a continuation of application Ser. No. 07/588,075, filed Sep. 25, 1990.

BACKGROUND AND SUMMARY OF THE INVENTION

The invention relates to a process and an arrangement for false-twist spinning in which a sliver is first drafted to the desired size in a drafting unit, subsequently passes through at least one false-twisting nozzle which provides the sliver with a false twist extending back to the drafting unit, and is withdrawn by a withdrawal device arranged behind the false-twisting nozzle.

A process for pneumatic false-twist spinning is described, for example, from the German Patent Document DE-A 37 14 212. In this process, the spreading-away of fiber ends is to be facilitated by the fact that a rotation body is arranged between the pair of delivery rollers of the drafting unit and the false-twisting nozzle, the rotation body having devices for changing the travelling direction of the sliver. As a result, a loosening or opening-up of the fiber structure is to be achieved so that the sliver widens in the transverse direction before entering into the false-twisting nozzle.

It is an object of the invention to provide a process of the initially mentioned type by means of which a yarn can be spun that is as uniform as possible in which a number of fiber ends that is as uniform as possible is wound around the yarn core in a uniform distribution.

This object is achieved in that an air current is applied to the sliver leaving the drafting unit the air current having at least one component that is transverse to the travelling direction of the sliver.

By means of this air current, a relatively large number of fiber ends which will then later be wound around the fiber core can be spread away from the sliver in a relatively uniform distribution.

In an advantageous development of the invention, it is provided that the air current has a component which is directed perpendicularly to the plane of a spinning triangle formed by the sliver at the pair of delivery rollers of the drafting unit. As a result, a large number of fiber ends can be spread away from the sliver.

In a further development, it is provided that the air current also has a component in the travelling direction of the sliver. By means of this measure, it is ensured that the spread-away fibers at first also remain spread away and in this spread-away position are taken along by the continuously travelling sliver.

In a further development of the invention, it is provided that the false twist introduced by the false-twisting nozzle and extending back to the drafting unit is weakened in the area of the sliver which leaves the drafting unit. This extends the length of the spinning triangle in the travelling direction of the yarn so that the spreading-away operation caused by the air current is improved and particularly longer fiber ends can be spread away.

In a further development of the invention, it is provided that fiber ends spread away from the sliver are placed against the sliver in such a way that they wind around it in the area having a false twist by means of a twisting which differs from the false twist. This achieves that the previously spread-away fiber ends, on the one hand, rest against the rotating sliver and do not remain spread-away as a result of centrifugal forces. Because of the twisting of the fiber ends which differs from the false twist of the sliver, the fiber ends, on the other hand, during the subsequent opening-up of the false twist, wind themselves still faster around the sliver so that a yarn is obtained around which the fiber ends are wound. As a result of the fact that the placing of the fiber ends on the sliver is carried out in a controlled manner, a uniform yarn is obtained. In order to implement the placing of the spread-away fibers, it is also provided that the spread-away fiber ends, by means of a guiding device which permits a rotating of the sliver as a result of the false twist are placed on the sliver having a false twist. In order to control the twist by means of which the fiber ends place themselves on the sliver, i.e., wind around it, it is provided in a further development that the guiding device, with at least one movement component, moves in the travelling direction of the sliver. In this case, it is particularly advantageous if it is provided in a further development of the invention that the guiding device takes along the fiber ends in the travelling direction of the sliver at a speed that is increased in comparison to the remaining sliver. As a result, it is achieved that the fiber ends move ahead of the sliver and are wound up with a wind-around direction which is opposite to the false twist so that, when the false twist is later opened up, the wind-around effect is reinforced.

In a further development of the invention, it is provided that the air current is led through the guiding device. As a result, a continuous transition is obtained from the spread-away area to the area in which the fiber ends are placed against the sliver. In this case, it is advantageous for the air current to be generated as a suction air current taken in through the guiding device.

In a further development of the invention, it is provided that the air current, at least in the area facing the drafting unit, flows laterally next to a guiding surface for the sliver. As a result, it is achieved that fiber ends are held separate from the sliver until they are placed against the sliver by means of the guiding surface.

As a development of the invention, an arrangement for false-twist spinning is provided having a drafting unit, at least one following false-twisting nozzle and a withdrawal device, in which devices are provided for generating an air current applied to a sliver leaving the drafting unit, which air current has at least one component which is directed transversely to the travelling direction of the sliver.

Other objects, advantages and novel features of the present invention will become apparent from the following detailed description of the invention when considered in conjunction with the accompanying drawings.

BRIEF DESCRIPTION OF THE DRAWINGS

FIG. 7 is a view of an embodiment similar to FIG. 1 with additional air guiding devices;

FIG. 8 is a partially sectional view of the embodiment according to FIG. 7 viewed in the direction of the arrow VIII;

DETAILED DESCRIPTION OF THE DRAWINGS

Figure 1:
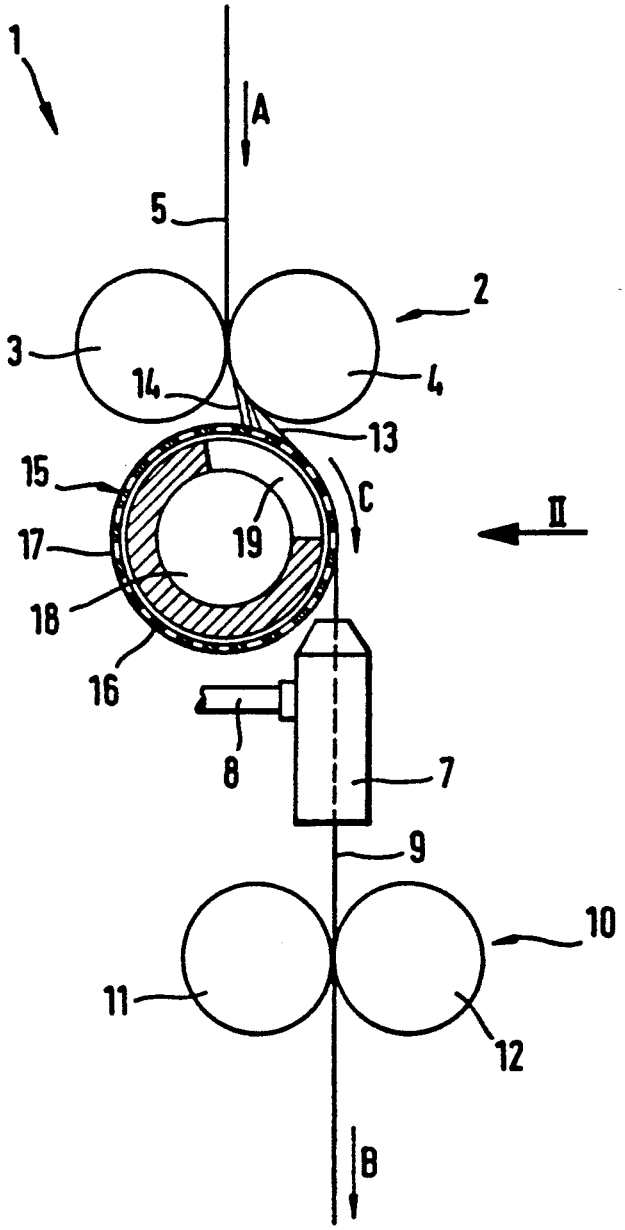
FIG. 1 is a schematic, partially sectional representation of an arrangement according to the invention for carrying out the process according to the invention.

In the drawings, only one spinning unit respectively is illustrated, which is a component of a machine which comprises a plurality of identical spinning units arranged next to one another in a row. The shown spinning unit comprises a drafting unit 1 of which only the pair of delivery rollers 2 is shown. The pair of delivery rollers 2 comprises a drivable bottom roller 3 and a pressure roller 4 which is pressed against the bottom roller in a known manner by means of a spring force. In the drafting unit 1, a sliver 5 which travels through the drafting unit 1 in the direction of the arrow (A) is drafted to the desired yarn size.

The drafting unit 1 is followed by a pneumatic false-twisting nozzle 7 which is connected to a compressed-air supply line 8. The finished spun yarn 9 is withdrawn by a withdrawal device 10 which comprises a drivable roller 11 and a pressure roller 12, and in the direction of the arrow (B), is fed to a wind-up device which is not shown.

Between the pair of delivery rollers 2 of the drafting unit 1 and the false-twisting nozzle 7, a cylindrical roller 16 is arranged, the shell surface of which forms a guiding surface 15 for the sliver 13 which in this area has a false twist. The roller 16, in a manner not shown in detail, is disposed so that it can be rotated around an axis extending in parallel to the axes of the pair of delivery rollers 2, and is provided with a drive. This drive, for example, by means of a toothed-belt drive, or the like, can be tapped off the drivable bottom roller. Roller 16 is provided with a perforation. In the interior of the roller 16, a suction insert 18 is arranged which is connected to a vacuum source and is provided with a suction slot 19. The roller 16 is arranged such that its axis of rotation is disposed approximately as an extension of the working direction of the drafting unit 1; i.e., as an extension of the travelling direction (A) of the sliver 5.

The false-twisting nozzle 7 is aligned tangentially with respect to the circumference of the roller 16 so that it is arranged offset with respect to the travelling direction of the sliver 5 by approximately half the diameter of the roller 16. The suction slot 19 of the suction insert 18 extends in the circumferential direction of the roller 16 along approximately one fourth of the circumference. Slot 19 is arranged such that it is aimed at the outlet area of the pair of delivery rollers 2 of the drafting unit 1, i.e., to the area of the wedge-shaped gap formed by the bottom roller 3 and the pressure roller 4. It will then extend in the circumferential direction over the circumferential area at which the sliver 13 is guided. The roller 16 is driven in the direction of the arrow (C), that is, in the travelling direction of the sliver 13. As will be explained later, it is provided in this case that the roller 16 has a circumferential speed which is higher than the speed of the moving sliver 13, preferably by a factor of approximately 1.3 to 1.8. The speed of the sliver 13 is determined by the delivery speed of the pair delivery rollers 2 of the drafting unit 1 and the withdrawal speed of the withdrawal device 10. In practice, it is provided that no drafting takes place in this area, i.e., that the delivery speed of the pair of delivery rollers 2 is equal to or slightly less than the withdrawal speed of the withdrawal device 10. It should be mentioned at this point that the roller 16 with its guiding surface 15 moves faster than the sliver 13 so that the sliver 13 slides on the guiding surface 15.

The roller 16 with the suction insert 18 disposed in it carries out several functions which each have an advantageous effect on the spinning result.

First, the roller 16 with the suction insert 18 provides that a relatively large number of fiber ends of the shell fibers 14, that is, of the fibers situated on the outside on the sliver 13, are spread away, resulting at the same time in a relatively uniform distribution of these spread-away fiber ends. This spreading-away is achieved in that a suction air current is generated which, in the area of the wedge-shaped gap between the bottom roller 3 and the pressure roller 4 of the pair of delivery rollers 2 acts upon the sliver 13 and has one component transversely with respect to the travelling direction of this sliver 13. This spreading-away of the fiber ends is supported by the fact that the sliver is deflected by the roller 16 in such a manner that, also after the nip line between the bottom roller 3 and the pressure roller 4, it still rests against the pressure roller 4 over a certain circumferential area. Free fiber ends which are not wound into the sliver 13 therefore have the tendency to spread away from the sliver 13. This spreading away is then reinforced by the air current which provides that the spread-away fiber ends first remain spread away from the sliver 13 and arrive on the guiding surface 15 of the roller 16 at a different point than the core of the sliver 13.

In addition, the roller 16 has the function of providing that the false-twist exercised by the false-twisting nozzle 7 extends back in the direction of the pair of delivery rollers 2 of the drafting unit 1 only in a weakened manner so that, in this area, the sliver 13 has less of a false twist. As a result, despite the low yarn tension, a relatively long spinning triangle is obtained from which fiber ends can be spread away more easily. However, attention should be paid to the fact that the false twist is not completely blocked in the area of the roller 16, but that it still extends back to a sufficient extent into the area of the pair of delivery rollers 2 of the drafting unit 1. This extending-back of the false twist is important because it ensures that the sliver 13 is not drafted or stretched in the area between the nip line of the pair of delivery rollers 2 and the roller 16 which has a higher speed than the delivery speed. The roller 16 is also arranged relatively closely to the nip line of the pair of delivery rollers 2 so that the distance between the guiding surface 15 of the roller 16 and the nip line of the pair of delivery rollers 2, if possible, does not exceed the average fiber length of the sliver 5 or 13.

In addition to the mentioned functions, the roller 16 also has another function, specifically the function of causing a controlled placing of the previously spread-away fiber ends onto the sliver 13, while the sliver rotates because of the false twist imparted to it. It will be attempted to explain this function below with reference to FIGS. 2 to 6. It is pointed out in this respect that only the case of an individual shell fiber 14 is considered here, specifically only in an ideal form, whereas, in the case of a spinning operation in practice naturally a large number of such fibers will act correspondingly with more or less extensive deviations.

Figure 2:
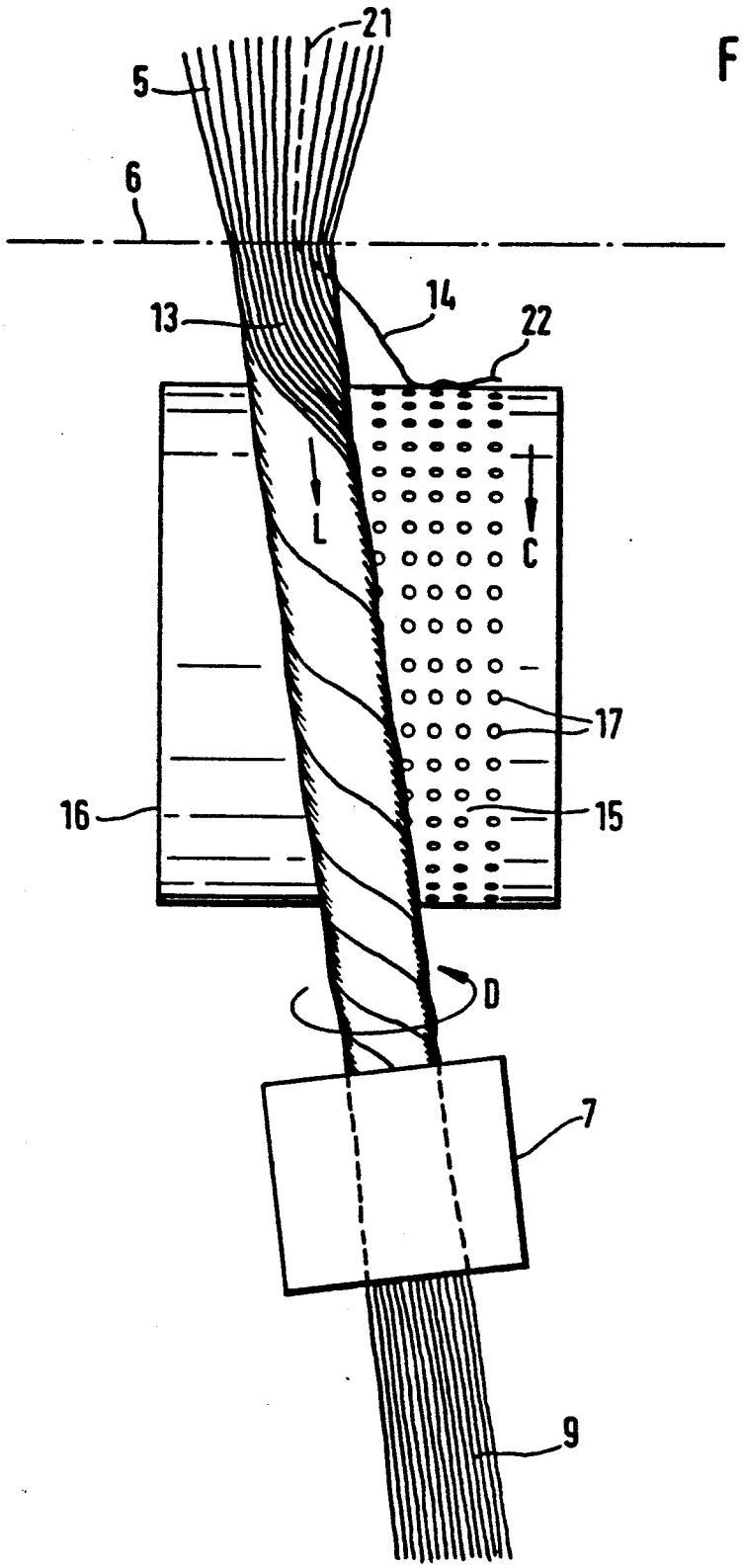
FIGS. 2 to 6 are enlarged views taken in the direction of the arrow 11 of FIG. 1, by means of which the formation of the yarn is explained.

In FIG. 2, the dash-dotted line 6 indicates the tip of the spinning triangle, that is, the end area into which the false twist extends back, which was imparted by the false-twisting nozzle 7. As mentioned above, the roller 16 has the effect that the false twist extending back weakens in the direction to the drafting unit 1. This means that the sliver 13 false-twisted in the direction of the arrow (D), in the area of the false-twisting nozzle 7, has a relatively high false twist, and in the area behind the roller 16—viewed against the moving direction (L)—has a weaker false twist.

It is assumed that the end piece 22 of a shell fiber 14 which moves ahead was spread away and was then picked up by the perforated guiding surface 15 of the roller 16 (FIG. 2).

Figure 3:
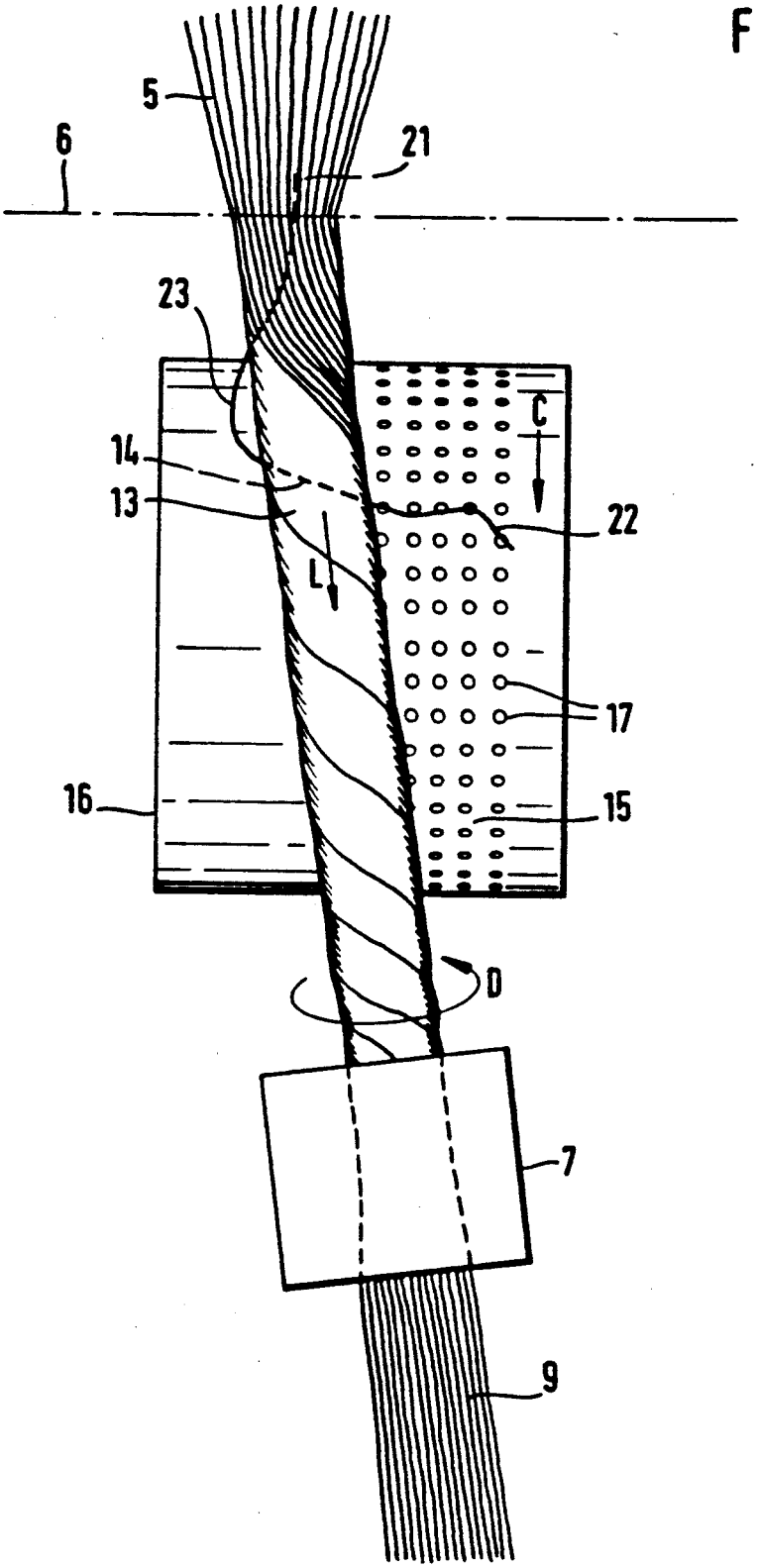
Figure 4:
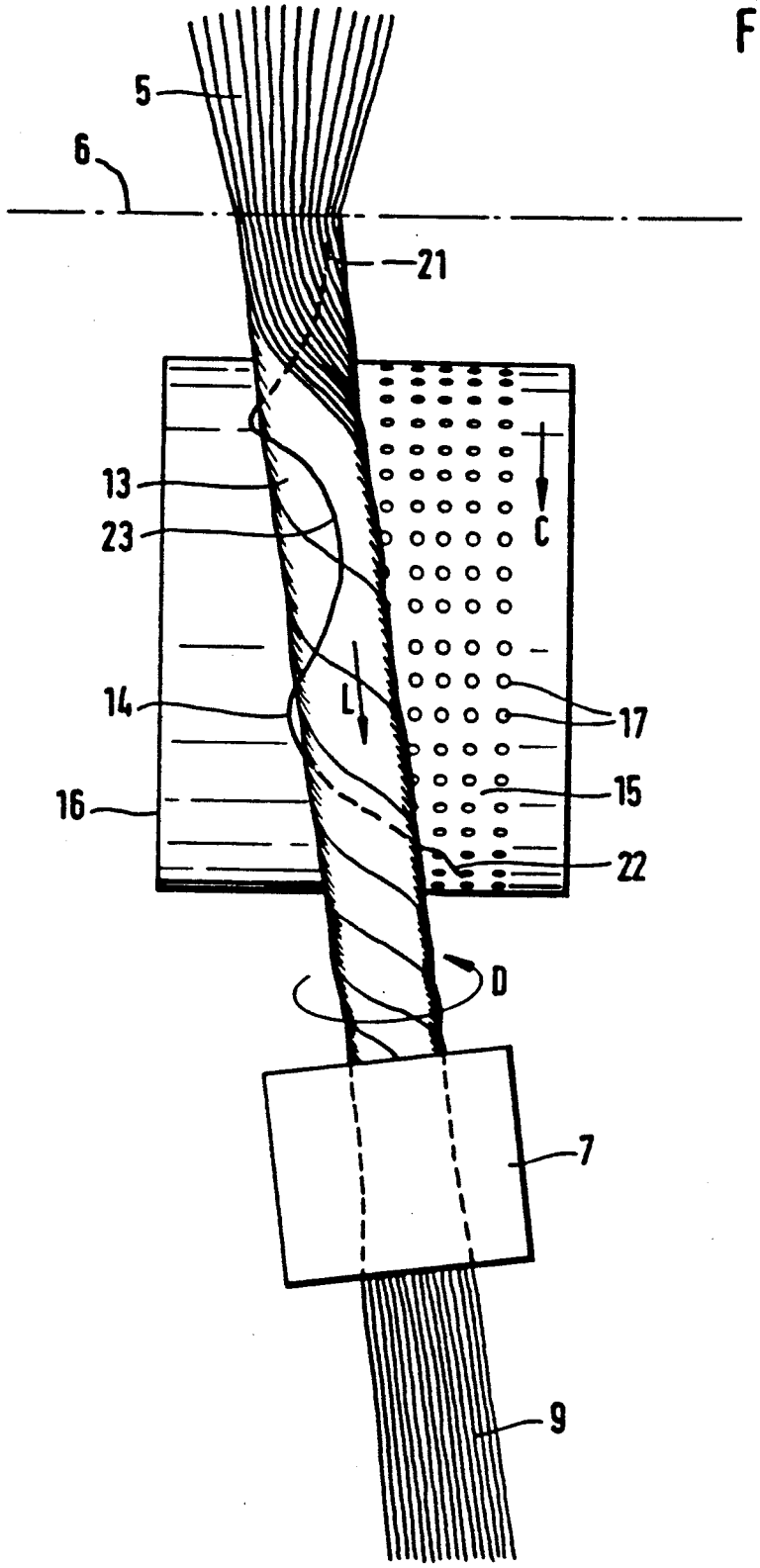
Figure 5:
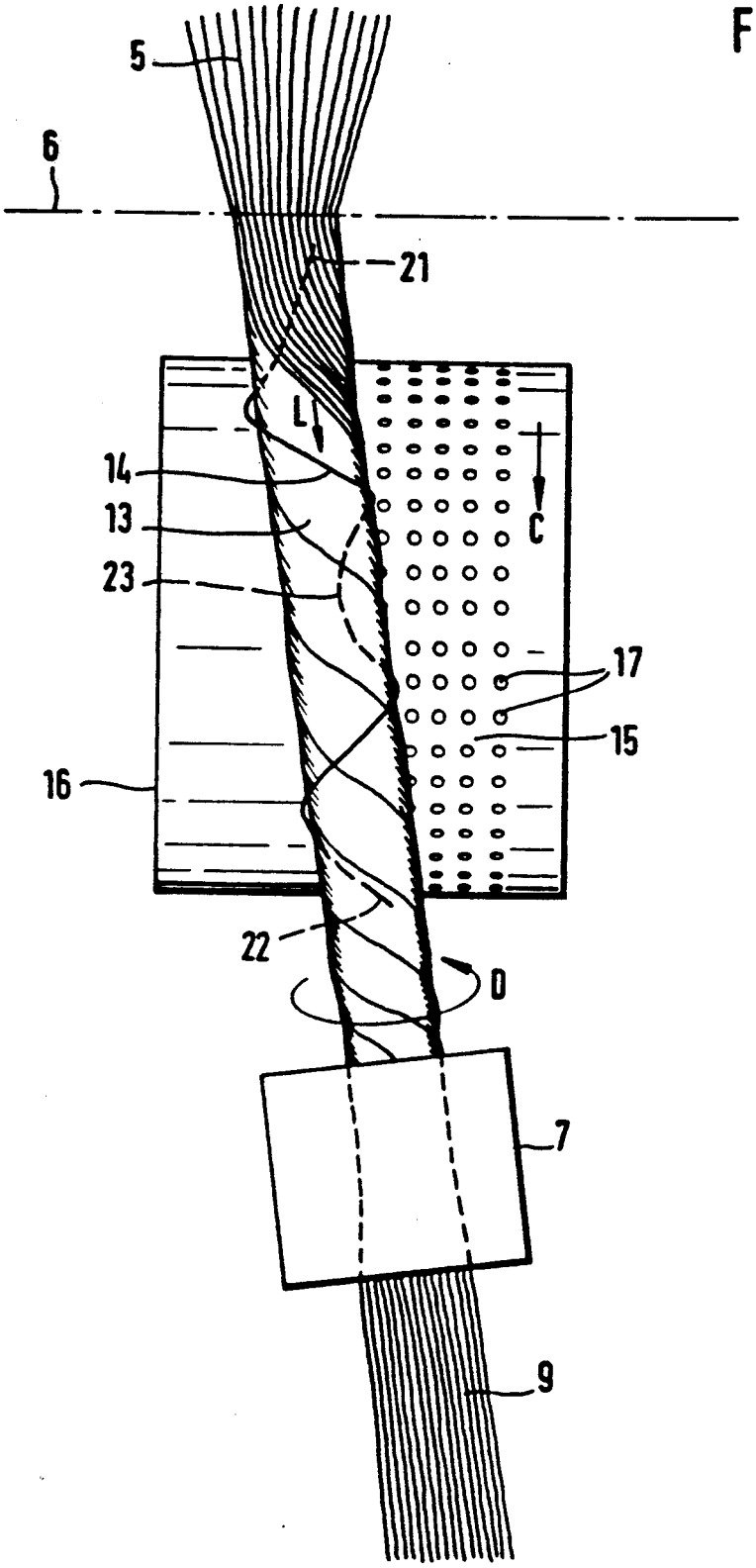

As mentioned above, the circumferential speed of the guiding surface 15 is higher than the withdrawal speed; i.e., the fiber end 22 gripped by the guiding surface 15 moves ahead of the sliver 13 in the travelling direction (L) (FIG. 3). In this case, the sliver 13 already rotates around its longitudinal axis as a result of the false twist provided to it. Because of this rotation, the fiber end 22 is wound helically around the sliver 13. Under certain circumstances, a loop 23 may be created in this case according to which the wind-around direction—viewed in the moving direction (L) of the sliver 13—extends against the rotating direction of the false twist. The guiding surface 15 on which the sliver 13 slides while, at the same time, it rotates around its longitudinal axis, provides that the fiber end 22 of the shell fiber 14 is placed against this area of the sliver 13 and does not remain spread-away because of the effects of the centrifugal force (FIG. 4 and 5).

Figure 6:
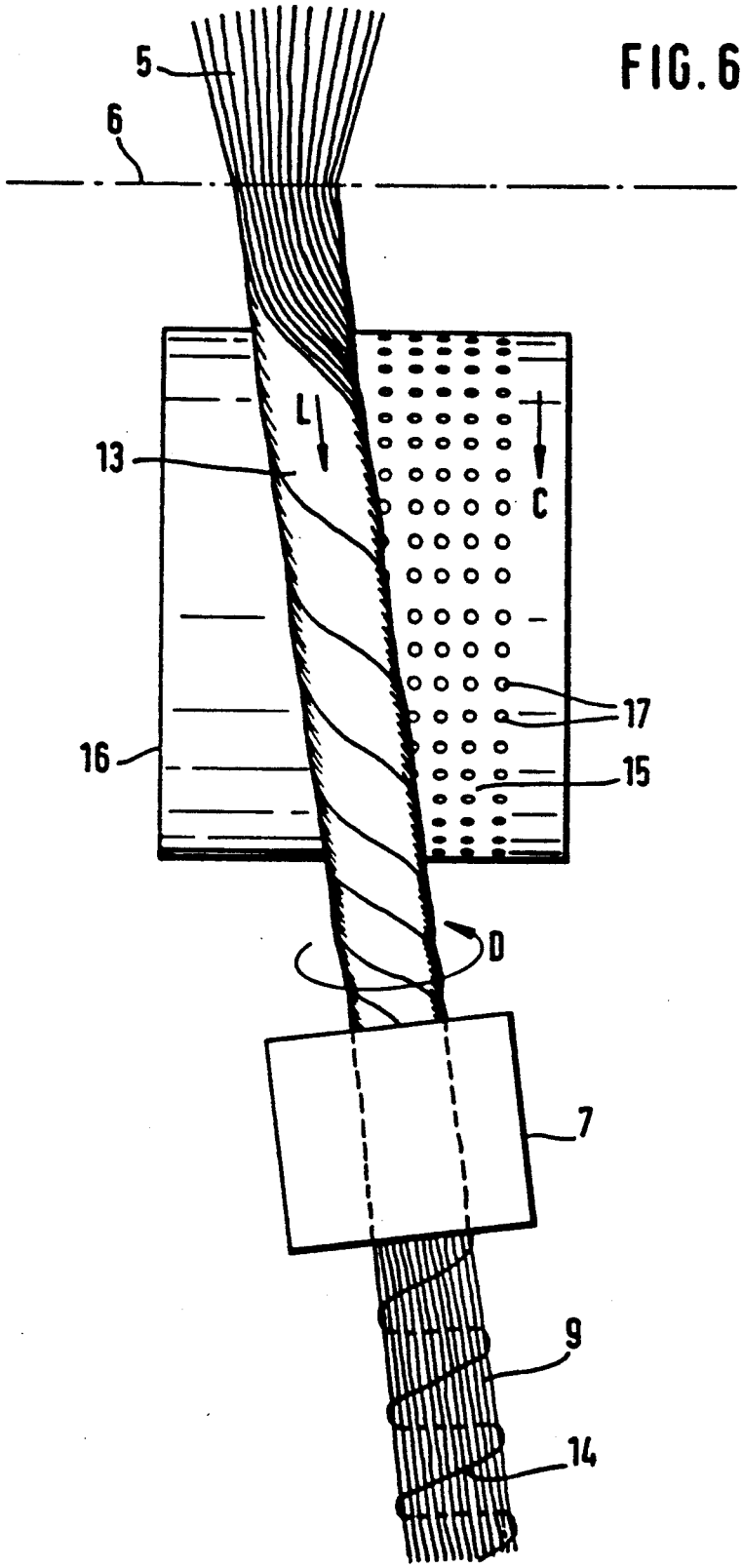

After passing through the false-twisting nozzle 7, the false twist provided to the sliver 13 opens up, the shell fiber 14 being taken along by the sliver 13 turning back against the previous false-twisting rotation, whereby the winding-around by the shell fiber 14 is reinforced (FIG. 6). Therefore, the shell fiber 14 will then form a wind-around fiber which provides the yarn 9 with its strength.

In the ideal case, it is endeavored that approximately 15% of the total number of fibers act in the manner described by means of an individual shell fiber 14 so that a relatively large number of windings is achieved with a uniform distribution over the length.

As indicated in the preceding description, the roller 16 has the effect that a spread-away fiber end 22 is taken along in the travelling direction (L) of the sliver 13 at a speed that is defined with respect to the sliver 13. If the speed at which the spread-away fiber ends 22 are taken along is higher than the speed of the sliver 13, the described conditions will occur. If, in contrast, it is provided that the speed of the spread-away fiber taken along by the guiding surface 15 of the roller 16 is equal to the speed of the sliver 13, a winding-up of the spread-away fiber end 22 because of the false twist takes place essentially only on an area which is narrowly limited in the travelling direction (L). During the opening-up of the false twist this area slightly pulls apart. If, on the other hand, a spread-away fiber end 22 is taken along at a lower speed in the travelling direction (L) of the sliver 13, a winding-around of the sliver 13 rotating as a result of the false twist takes place essentially in the direction of the false twist, however, with a deviating slope. Since, in this case also, the fiber ends 22 do not also carry out the full false twist, they are, when the false twist opens up, wound around the sliver 13 against the previous false-twisting direction. It is therefore possible to determine the appearance and the characteristics of the future yarn 9 by means of the selection of the speed of the guiding surface 15 in the travelling direction (L) of the sliver 13.

As also indicated in the explanations of FIGS. 2 to 6, it is expedient for the spread-away fiber ends 22 to be held spread-away from the sliver 13 at least toward the side. As a result, it is avoided that the sliver 13 which otherwise may possibly slide on the guiding surface 15 above the spread-away fiber ends 22 may interfere with the winding-around during the false twist. This may be achieved by the fact that the zone with the perforation 17 of the guiding surface 15 is arranged laterally next to the travelling direction (L) of the sliver 13. Likewise, it is possible, as illustrated in FIGS. 2 to 6, to select the travelling direction (L) of the sliver 13 such that it travels obliquely over the guiding surface 15 so that, in the area facing the drafting unit 1, the perforation 17 is first situated next to the sliver 13. This oblique entering may take place by means of a corresponding oblique arranging of the roller 16 or by means of an oblique arranging of the false-twisting nozzle 7, as illustrated in FIGS. 2 to 6.

In principle, the embodiment according to FIG. 7 and 8 corresponds to the embodiment according to FIG. 1. However, as illustrated in FIG. 7, the circumferential area of the guiding surface 15 of the roller 16 over which the sliver 13 slides was reduced a a result. In addition, it is provided in the embodiment according to FIG. 7 and 8 that the area of the pair of delivery rollers 2 and of the roller 16 is covered by an air guiding element 24 which forms air guiding surfaces which provide that the essential amount of air, corresponding to arrows E and F, is taken in by way of the wedge-shaped gap area on the delivery side of the pair of delivery rollers 2. The air guiding element 24 which is a covering hood made of plastic may be connected with the shafts 24a of the pressure rollers 4 in a manner similar to known apron cages and may support itself on the inlet side of the false-twisting nozzle 7. For this purpose, guides 28 are provided laterally of the false-twisting nozzle 7.

The air guiding element 24 which has an essentially U-shaped cross-section, by means of its legs 27, covers the area of the wedge-shaped gap of the pair of delivery rollers 2 and the front-side area of the roller 16 at least to the extent of the suction slot 19.

In the embodiment according to FIG. 7 and 8, it is also provided, as shown in FIG. 8, that the perforated area of the guiding surface 15 of the roller 16 which therefore is under the suction effect of the suction slot 19, exists only on one side of the path along which the sliver 13 normally travels.

Figure 9:
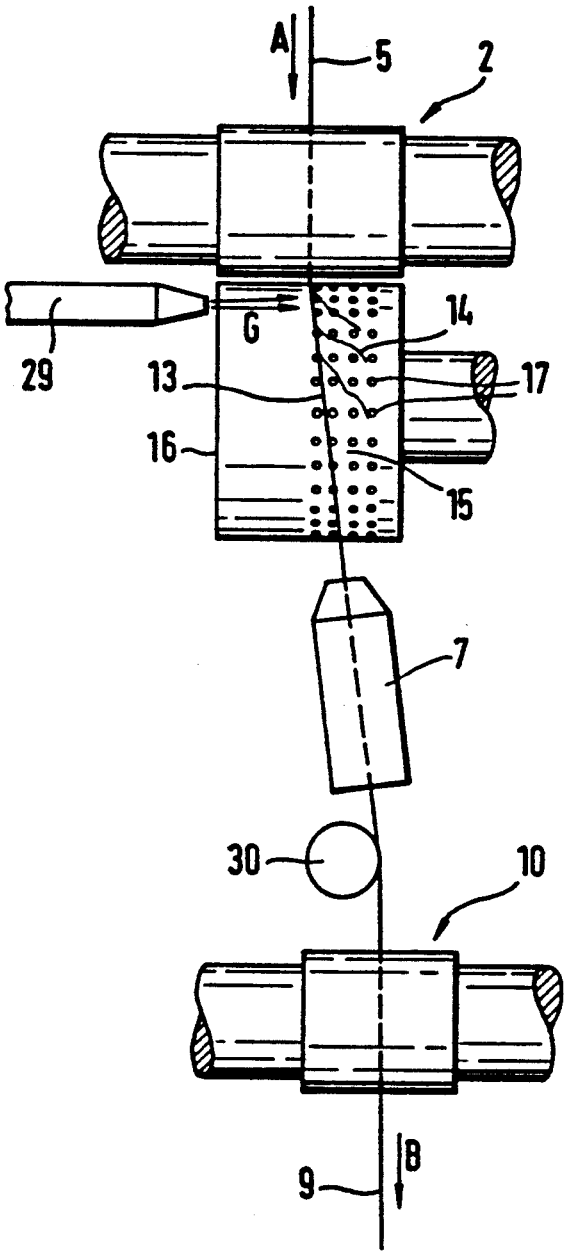
FIG. 9 is a view of another embodiment of a blow device for the spreading-away of fiber ends.

The embodiment according to FIG. 9 corresponds essentially to the embodiment on which the representations according to FIGS. 2 to 6 are based. As illustrated in FIG. 9, the air nozzle 7 is arranged obliquely with respect to the travelling direction (A) of the sliver 5 inside the drafting unit 1 so that the sliver 13 slides diagonally over the guiding surface 15. The perforations 17 are limited to only on section of the guiding surface 15 which is situated in the area facing the pair 2 of delivery rollers, next to the travelling path of the sliver 13. The false-twisting nozzle 7 is then followed by a guiding element 30 at which the yarn 9 is deflected such that it again enters radially with respect to the withdrawal device 10.

In the embodiment according to FIG. 9, a blowing-air nozzle 29 is also provided which is arranged directly behind the pair of delivery rollers 2, that is, in the area in which fiber ends are spread away from shell fibers 14. The blow nozzle 29 blows out an air current in the direction of the arrow (G) which, in the shown embodiment, is aimed in parallel to the shafts of the pair of delivery rollers, i.e., transversely with respect to the travelling direction of the sliver. In a modified embodiment, the blow nozzle 29 is arranged and/or shaped such that the blown-out air current, in addition, also has a component in the travelling direction of the sliver 13.

Figure 10:
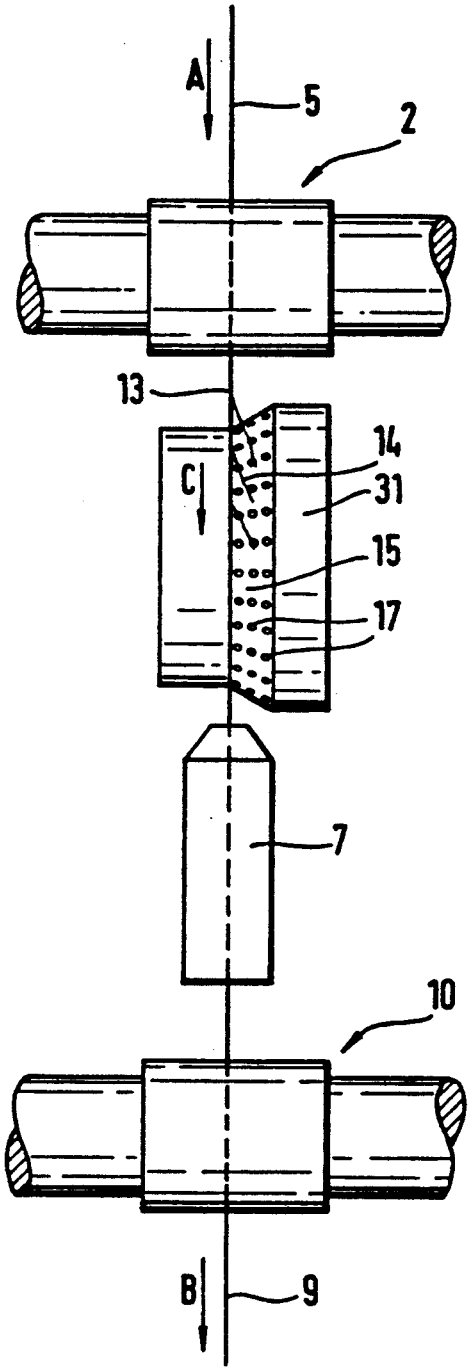
FIG. 10 is a view of an embodiment in which a guiding surface is separate from a suction area.

In the embodiment according to FIG. 10, a roller 31 is arranged between the pair of delivery rollers 2 of a drafting unit 1 and a false-twisting nozzle 7 in a manner corresponding to the embodiment according to FIG. 1, the guiding surface 15 of this roller 31, however, not being constructed as a pure cylindrical surface but as a cylindrical surface with a connecting conically widening part. This area of the guiding surface 15 which widens conically from the direction of the travelling area of the sliver 13 is provided with a perforation and a suction insert corresponding to the embodiment according to FIG. 1. In the case of this embodiment, increased circumferential speeds of the guiding surface 15 are obtained with an increasing distance from the travelling area of the sliver 13 so that the farther-projecting fiber ends of shell fibers 14 are taken along faster in the circumferential direction and thus in the travelling direction of the sliver 13. In the case of this embodiment, it is ensured that, also during rotation movements because of the provided false twist, the sliver 13 remains essentially outside the perforated area of the guiding surface 15.

Figure 11:
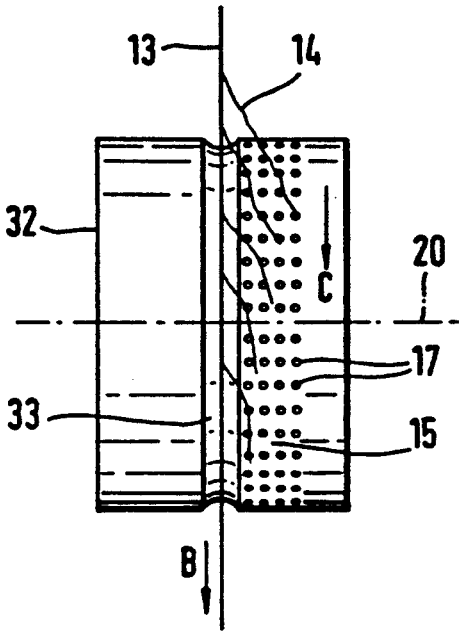
FIG. 11 is a view of a roller-shaped device for the spreading-away and placing-on of fiber ends which has a groove-shaped fiber guiding surface which is separate from a suction area.

FIG. 11 shows a roller 32 which can be used in the embodiment according to FIG. 1 or 7 and 8 instead of roller 16. This roller 32 is provided with a groove 33 having an approximately semicircular groove base which is arranged in a radial plane, the sliver 13 being slidingly guided in this groove base. It is only next to the groove that a perforated guiding surface 15 is provided which grips the spread-way fiber ends of shell fibers 14 and takes them along in the travelling direction of the yarn.

Figure 12:
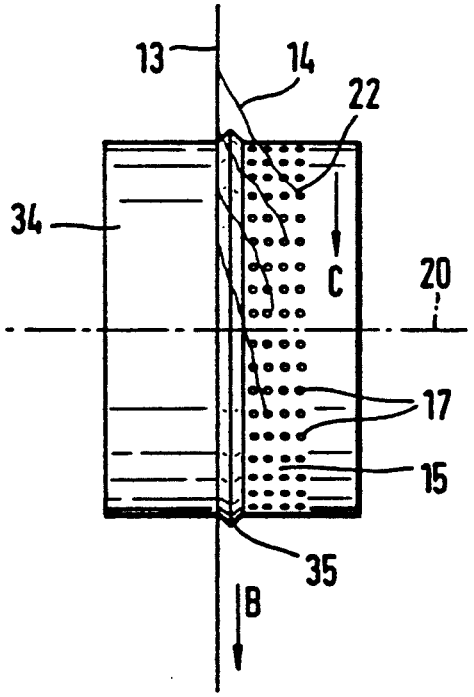
FIG. 12 is a view similar to FIG. 11 in which, for the separation of the fiber guiding surface from a suction area, a surrounding annular bead is provided.

FIG. 12 shows a roller 34 which may also be used instead of roller 16 in the embodiment according to FIG. 1 or 7, 8. In this embodiment, the guiding surface is divided by means of a torus 35 having an essentially triangular cross-section into an area that is not perforated and is therefore not subjected to suction and into an area that is perforated and is therefore subjected to suction. The sliver 13 travels in the area that is not perforated and is not subjected to suction, while spread-away fiber ends 22 of shell fibers 14 are deflected laterally to this area provided with a perforation 17 and are taken along by it at an increased speed in the travelling direction of the sliver 13.

In the case of the embodiments having an only one-sided perforation corresponding to the embodiments according to FIGS. 2 to 6, 7, 8, 9, 10, 11 and 12, it is expedient for the perforated area of the guiding surfaces 15 to be arranged laterally of the sliver 13 as a function of the rotating direction of the false twist in such manner that the sliver 13 which rotates because of the false twist pulls the spread-away fiber ends 22 through between itself and the guiding surface 15 when placing them against the sliver 13, as illustrated in FIGS. 2 to 6.

Figure 13:
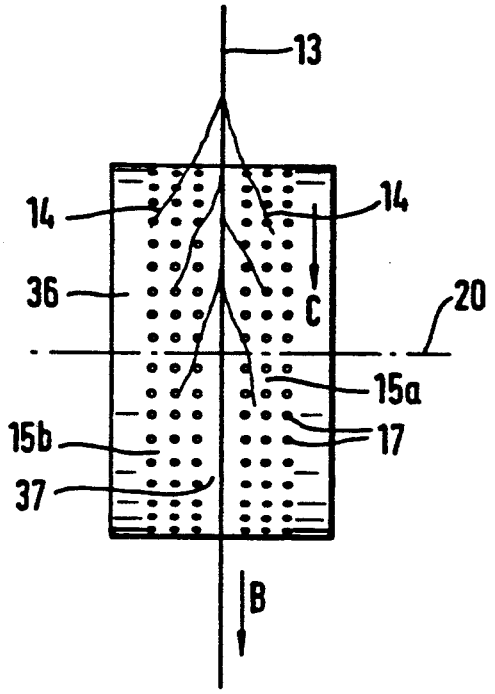
FIG. 13 is a view similar to FIG. 11 and 12 with suction areas arranged on both sides of a guiding surface.

FIG. 13 shows a roller 36 which ma also be used in the embodiments according to FIG. 1 or 7, 8. This roller 36 is provided with a central unperforated area 37 in which the sliver 13, that is, the yarn core, is guided. On both sides of this unperforated guiding area 37, guiding surfaces 15a, 15b are arranged which are provided with perforations 17 and which grip the spread-away fiber ends of shell fibers 14 and take them along in the travelling direction of the sliver 13 in order to thus check the winding-around in the area of the sliver 13 having a false twist. In this embodiment, as in all other embodiments, the area of the drum 36 over which the sliver slides 13 may have a special surface structure in order to obtain a specific fiber characteristic. For example, a coating and/or a roughening of the surface or a particularly smooth surface may be created.

Figure 14:
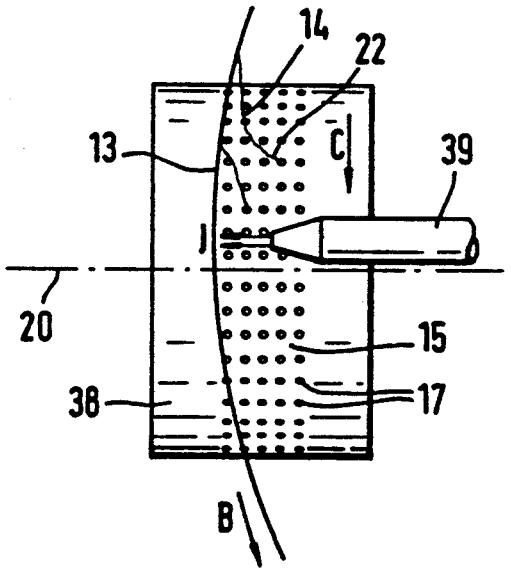
FIG. 14 is a view of am embodiment having an additional blow nozzle.

FIG. 14 shows a roller 38 which, in its central area of the guiding surface 15, is provided with a perforation and a corresponding interior suction insert corresponding to FIG. 1 or 7, 8. In order to move the yarn travelling path at least partially outside this perforated area, a blow nozzle 39 is provided which aims a blowing air current (I) at the sliver 13 and thus deflects it, in a curved manner, out of the perforated area. In the shown embodiment, an axial blowing direction is provided along the shell surface of the roller 38. In a modified embodiment, it is provided that the blowing direction has an additional component in the travelling direction or the countertravelling direction of the sliver.

Figure 15:
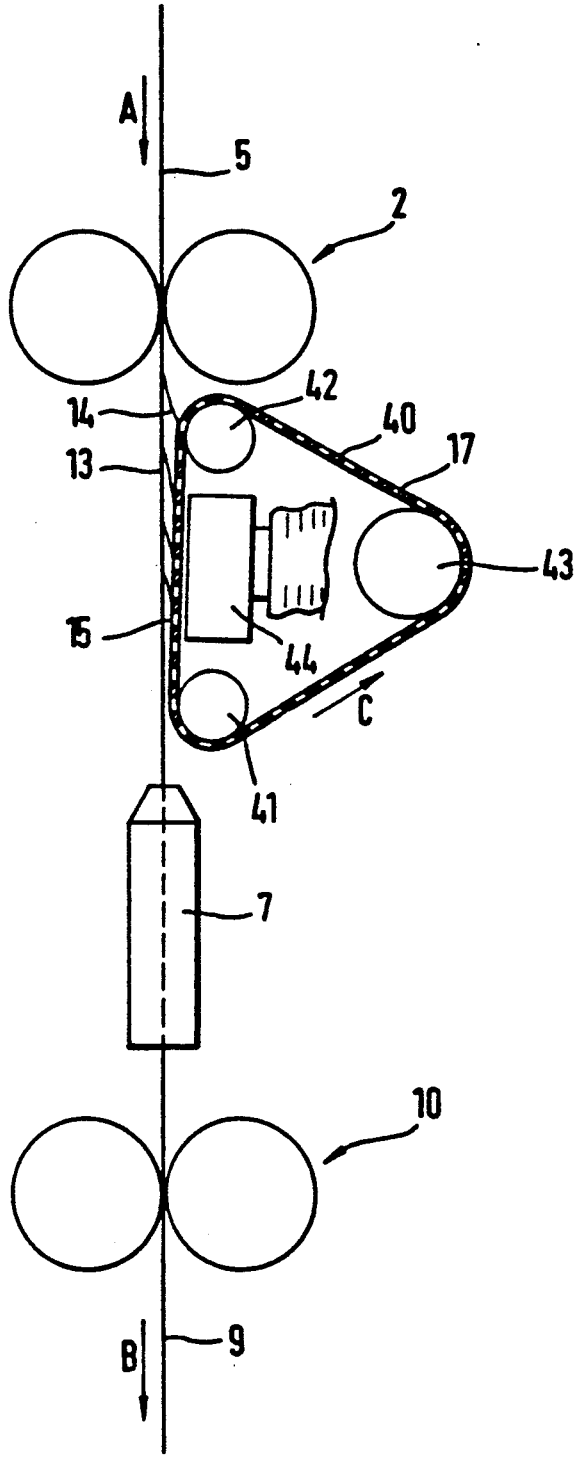
FIG. 15 is an embodiment with a sieve belt subjected to suction and arranged between the pair of delivery rollers of a drafting unit and a false-twisting nozzle.

In the embodiment according to FIG. 15, a sieve belt 40 is provided as a guiding surface between the pair of delivery rollers 2 of a drafting unit and the false-twisting nozzle 7 arranged as a linear extension of it. The sieve belt 40 travels around deflection pulleys 41, 42, 43 of which one is provided with a drive. On the side of the sieve belt 40 facing away from the sliver 13, a suction device 44 is arranged in the area of the guiding surface 15. In the case of this construction, it is provided that the sliver 13 itself has no contact with the guiding surface 15. The guiding surface 15 is used only for holding the spread-away ends of shell fibers 14 and taking them along in the travelling direction of the sliver 13 in order to check the winding-around.

Figure 16:
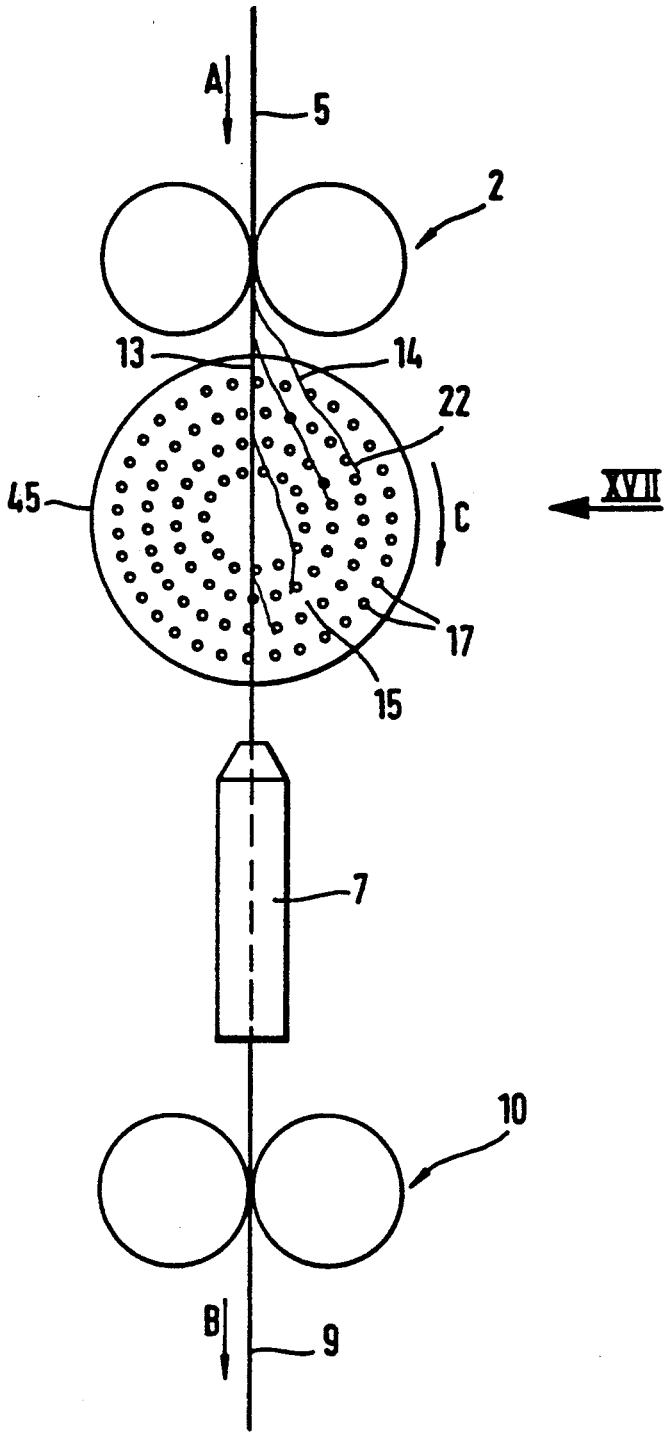
FIG. 16 is an embodiment with a sieve disk subjected to suction and arranged between the pair of delivery rollers of a drafting unit and a false-twisting nozzle.
Figure 17:
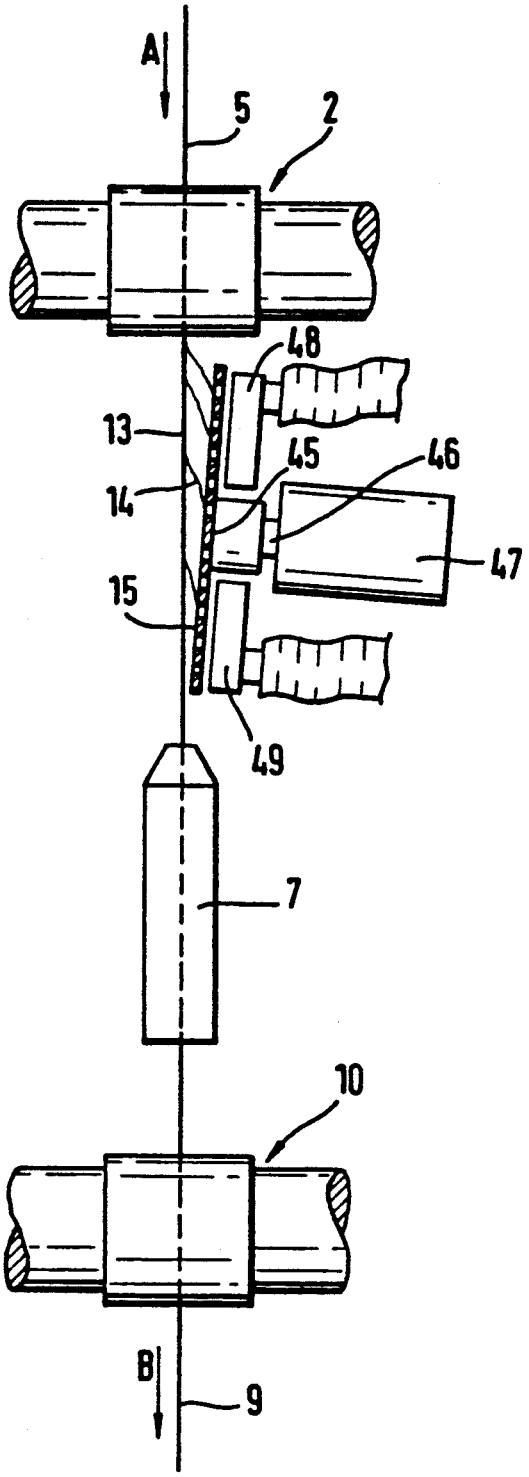
FIG. 17 is a view in the direction of the arrow XVII of the embodiment according to FIG. 16.

In the embodiment according to FIG. 16 and 17, a sieve disk 45 forming a guiding surface 15 is arranged between the pair of delivery rollers 2 of a drafting unit and a false-twisting nozzle 7 arranged as a linear extension of it, this sieve disk 45 being driven by means of a motor 47 to perform rotations around a shaft 46 extending transversely with respect to the travelling direction of the sliver 13. On the side of the sieve disk 45 facing away from the sliver 13, two suction devices 48, 49 are provided which are arranged behind one another in the travelling direction of the sliver 13 and may be arranged to be slightly laterally offset with respect to it. The shaft 46 of the sieve disk 45 is set to be slightly oblique so that in the area in front of the false-twisting nozzle 7, the sieve disk 45 is situated closer to the sliver 13 than in the area behind the pair of delivery rollers 2 of the drafting unit. Also in this embodiment, the free ends 22 of shell fibers 14 place themselves against the fiber guiding surface 15 at least at times. As a result, the shell fibers 14 are subjected to a certain tensile stress and are stretched. While the sieve disk 45 rotates in the direction of the arrow (C)—by means of the spooling of the shell fibers 14 around the false-twisted sliver 13—the free ends of the shell fibers 14 become shorter which is taken into account by the oblique positioning of the sieve disk 45. The shell fibers 14 are therefore first led away from the sliver 13 while they are spooled up by it at the same time and are subsequently brought close to the sliver 13 again, whereby the free ends 22 are held on the guiding surface 15 as long as possible. In any case, they are prevented from performing the false twist in the same manner as the sliver 13. Although the shell fibers 14 are stretched, they are not stretched excessively before entering into the false-twisting nozzle 47 so that a yarn 9 is obtained which has a wound-around shell that is not too tight.

Figure 18:
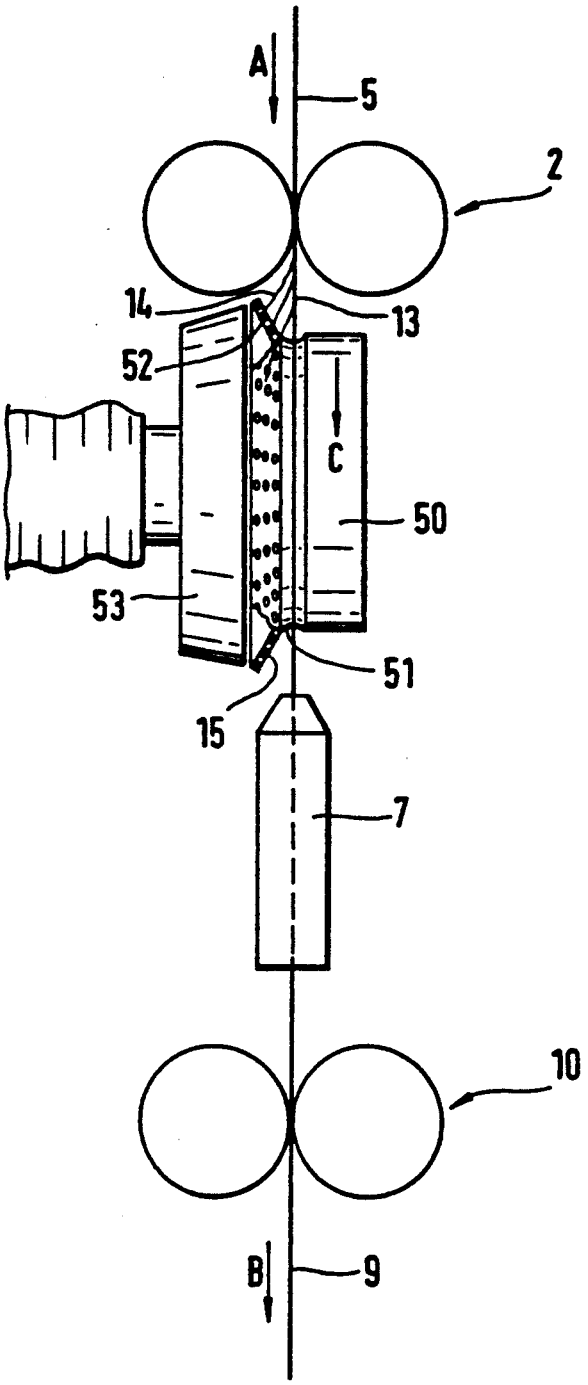
FIG. 18 is an embodiment having a rotation body arranged between the pair of delivery rollers of a drafting unit and a false-twisting nozzle, the rotation body having a conical sieve surface which is subjected to suction and a connecting guiding groove for the sliver.

In the embodiment according to FIG. 18, a roller 50 equipped with a suction device 53 is arranged between the pair of delivery rollers 2 and the false-twisting nozzle 7 corresponding to FIG. 1 or FIG. 7, 8. The roller 50 has a cylindrical area to which a groove 51 is connected which forms the actual travelling path for the sliver 13. A conical or truncated-cone-shaped guiding surface 15 then connects to it which is provided with a perforation 52 subjected to suction. In this embodiment, the axis of the drivable roller 50, in contrast to the embodiment according to FIG. 1 or 7, 8, extends in a plane which extends transversely with respect to the plane of the axes of the pair of delivery rollers 2. As a result, it is possible to move the truncated-cone-shaped guiding surface 15 close to the wedge-shaped gap on the delivery side of the pair of delivery rollers 2. Also in this embodiment, ends of shell fibers 14 are spread away and are taken along by the guiding surface 15 such that, in a controlled manner, they wind around the yarn rotating around its longitudinal axis as a result of the false twist.

Figure 19:
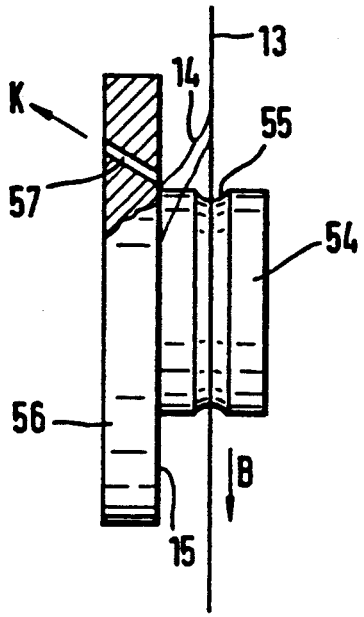
FIG. 19 is a view of a rotation body similar to the rotation body of the embodiment according to FIG. 18.

FIG. 19 shows a roller 54 which ca be used instead of the roller 50 in the embodiment according to FIG. 18. This roller 54 is first provided with a groove 55 determining the travelling direction of the sliver 13 and having an approximately semicircular cross-section. A collar 56 forming a guiding surface 15 is situated laterally of this groove 55. The collar 56 is provided with ventilation bores 57 which are arranged obliquely in such a manner that their openings, on the side facing the groove 55, are situated on a smaller diameter than the openings situated on the other side of the collar. The roller 54 is driven to perform rotations by means of a drive which is not shown so that, as a result of the rotation, the ventilation bores generate an air current (K). This roller 54 therefore requires no additional suction device. The spread-away fiber ends of the shell fibers 14 are gripped by this suction air current and are taken along. Also in this embodiment, it is expediently provided that the fiber ends are taken along in the travelling direction at a speed that is increased in comparison to the sliver 13.

Figure 20:
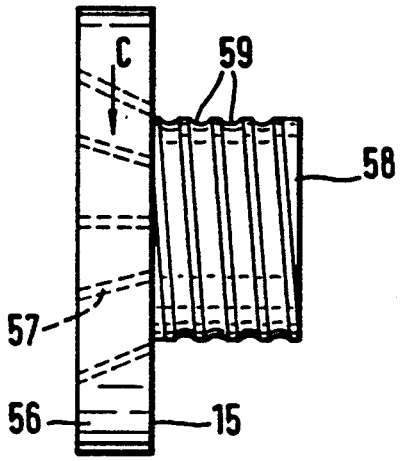
FIG. 20 is a schematic view of an embodiment having a rotation body which has a guiding surface for the sliver which is constructed as a spiral groove.

FIG. 20 shows a modification of the embodiment according to FIG. 1. In the case of this roller 58, a helical-line-shaped groove 59 is provided instead of a groove 55 disposed in a radial plane. As a result of the rotating direction of the roller 58, the sliver 13 disposed in the helical-line-shaped or thread-type ring groove, in the travelling direction, is moved closer to the collar 56, whereby the circumstance is taken into account that the fiber ends taken along by the guiding surface 15 become increasingly shorter.

Figure 21:
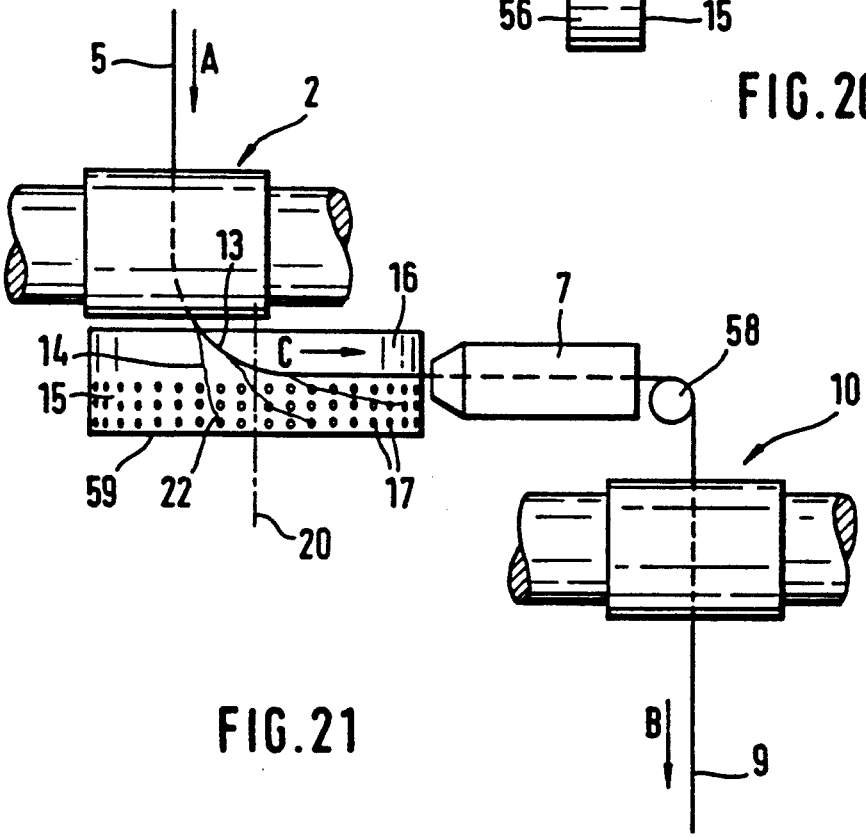
FIGS. 21 and 22 are schematic views of embodiments in which a 90° deflection of the travelling path of the yarn takes place between a pair of delivery rollers of a drafting unit and a false-twisting nozzle, in which case a rotation body is arranged in the area of this deflection which controls the spreading-away of fiber ends and the placing-on of fiber ends.
Figure 22:
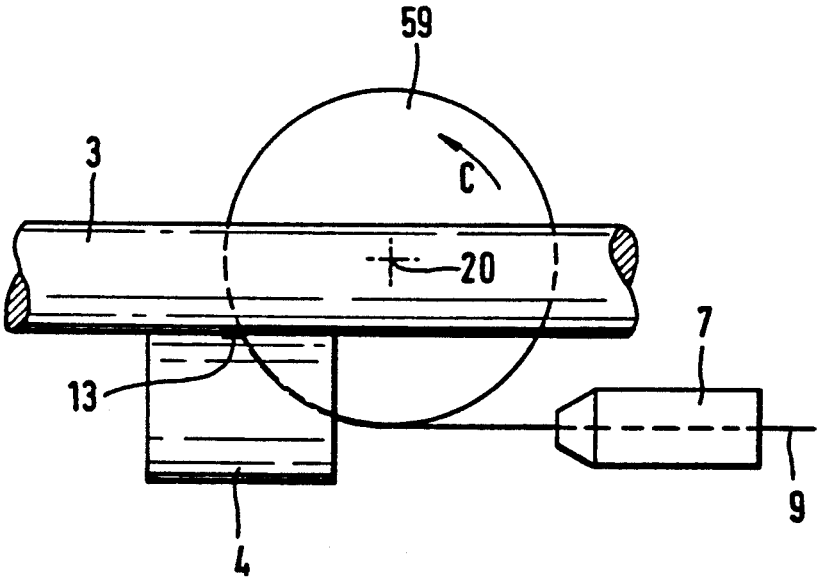

Also in the embodiment according to FIG. 21 and 22, the explained principle is used according to which it is provided directly behind the pair of delivery rollers 2, that fiber ends 22 of edge fibers 14 spread away in sufficiently large numbers from the sliver 13, are then, while moving ahead, conveyed into the travelling direction of the sliver 13 and, in a controlled manner, are wound around the sliver 13 which rotates because of the false twist. In the embodiment according to FIG. 21, it is provided that a guiding surface 15 is arranged between the pair of delivery rollers 2 of the drafting unit and a false-twisting nozzle 7, this guiding surface 15 moving in the travelling direction of the sliver 13, preferably at a speed that is increased with respect t the speed of the sliver 13 so that the sliver 13 slides on it. The guiding surface 15 is provided with a perforation 17 which receives spread-away fiber ends 22 and takes them along in the travelling direction of the sliver 13, while, in the process, they are wound on the sliver 13 rotating around its longitudinal axis because of the false twist. In the embodiment according to FIG. 21, a roller 59 is provided which, on the inside, is provided with a suction insert which by means of a suction slot is directed to the area of the perforation 17. The axis 20 of rotation of the roller 59 is disposed in parallel to the travelling direction (A) of the sliver 5 so that the sliver 13 provided with the false twist is deflected by approximately 90°. The false-twisting nozzle 7 extends in the corresponding direction. A deflecting roller 58 is arranged behind the false-twisting nozzle 7 and deflects the yarn 9 to a withdrawal device 10 by a direction (B) which is in parallel to the passage direction (A) of the sliver 5 in the drafting unit. In a modified embodiment, a sieve belt corresponding to FIG. 15 is provided instead of the roller 59, this sieve belt, by means of its end serving as the guiding surface 15 to which a suction device is assigned, being disposed at the level of the nip line of the pair of delivery rollers 2 and moving in parallel to this nip line.

Each of the individual functions of the guiding surface 15 of the embodiments shown in the figures, by itself, result in an improvement of the yarn quality in comparison to previously known pneumatic false-twisting devices. Thus, the increased spreading-away of fiber ends which is caused or at least promoted by the air current, already leads to a significant improvement even if subsequently the winding around of the spread-away fiber ends does not take place in the controlled manner. However, mainly the winding-around in a controlled manner, particularly if the fiber ends are taken along while moving ahead of the sliver 13 and in the process are wound up around the sliver 13 rotating because of the false twist, results in a considerable improvement even if the spreading-away of the fiber ends themselves is not reinforced in the explained manner but if only the accidentally spread-away fiber ends are utilized for this purpose.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed is:

1. A process for spinning a sliver comprising:

drafting a sliver to a desired size in a drafting unit, passing the drafted sliver through at least one false-twisting nozzle to provide the sliver with a false twist extending back to the drafting unit, withdrawing the sliver utilizing a withdrawal device arranged downstream of the at least one false-twisting nozzle, applying a moving guiding surface to the sliver at a location intermediate the drafting unit and the at least one false-twisting nozzle, wherein the guiding surface is driven at a speed which is higher than the delivery speed of the drafting unit and higher than the withdrawal speed of the withdrawal device such that yarn outer edge fibers are detached from centrally yarn core regions and are accelerated to a higher speed than the central yarn core regions, and applying an air current to the sliver at a position downstream of the drafting unit and upstream of portions of the guiding surface and of the at least one false-twisting nozzle in an area where a spinning triangle is formed in the slivers with a triangle base at the outlet of the drafting unit and a triangle apex downstream thereof, said air current having a component in the transverse direction of the travel path of the sliver, whereby the air current is effective in controlling fibers in the sliver by spreading away large numbers of the fiber ends from the fiber core of the sliver before the sliver experiences substantial twisting caused by the at least one false-twisting nozzle.

2. A process according to claim 1, wherein the applying the air current includes applying an air current which also has a component in the travelling direction of the sliver.

3. A process according to claim 1, comprising weakening the false twist introduced by the at least one false-twisting nozzle and extending back to the drafting unit by said air current in the area of the sliver leaving the drafting unit.

4. A process according to claim 1, comprising placing fiber ends spread-away from the sliver by the air current against the sliver in such a manner that they wind around it by means of a rotation deviating from the false twist rotation in the area having a false twist.

5. A process according to claim 4, comprising placing the spread-away fiber ends against the sliver having a false twist by means of the guiding surface permitting a rotating of the sliver because of the false twist.

6. A process according to claim 5, comprising moving the guiding surface into the travelling direction of the sliver with at least one moving component.

7. A process according to claim 6, comprising taking along the fiber ends in the travelling direction of the sliver by the guiding surface at a speed that is increased in comparison to the remaining sliver.

8. A process according to claim 5, comprising guiding the air current through a guiding device on which the guiding surface is located.

9. A process according to claim 8, comprising generating the air current as a suction air current taken in through the guiding device.

10. A process according to claim 9, wherein the air current, at least in the area facing the drafting unit, flows laterally next to a closed guiding surface for the sliver.

11. A process according to claim 5, comprising moving a guiding surface of the guiding device with respect to the travel direction of the sliver.

12. A process according to claim 11, wherein the guiding device is a rotatable member with a circumferential surface serving as the guiding surface.

13. A process according to claim 12, wherein said circumferential surface includes perforations through which at least a portion of said air current flows.

14. A process according to claim 1, wherein said drafting unit includes a pair of delivery rollers at its downstream end, and wherein said applying the air current includes applying said air current to an area adjacent the deliver rollers.

15. A process according to claim 14, wherein the applying the air component includes applying said air current so as to have a component which is aimed perpendicularly to the plane of the spinning triangle formed by the sliver immediately downstream of the pair of delivery rollers of the drafting unit.

16. A process according to claim 15, wherein the applying the air current includes applying an air current which also has a component in the travelling direction of the sliver.

17. A process according to claim 16, comprising weakening the false twist introduced by the at least one false-twisting nozzle and extending back to the drafting unit by said air current in the area of the sliver leaving the drafting unit.

18. A process according to claim 17, comprising placing fiber ends spread-away from the sliver by the air current against the sliver in such a manner that they wind around it by means of a rotation deviating from the false twist rotation in the area having a false twist.

19. A process according to claim 18, comprising placing the spread-away fiber ends against the sliver having a false twist by means of the guiding surface permitting a rotating of the sliver because of the false twist.

20. A process according to claim 19, comprising moving the guiding surface into the travelling direction of the sliver with at least one moving component.

21. A process according to claim 20, comprising taking along the fiber ends in the travelling direction of the sliver by the guiding surface at a speed that is increased in comparison to the remaining sliver.

22. An arrangement for spinning a sliver comprising:

a drafting unit for drafting a sliver to a desired size therein, at least one false-twisting nozzle for providing the sliver with a false twist extending back to the drafting unit, a withdrawal device for withdrawing the sliver arranged downstream of the at least one false-twisting nozzle, a guiding element which is arranged between the drafting unit and the false-twisting nozzle, said guiding element being driven to perform rotations around an axis disposed transversely with respect to the yarn travelling direction, said guiding element forming a deflection with a yarn guiding surface moving in the travelling direction of the yarn and configured to cause relative sliding movement of the yarn on the yarn guiding surface, wherein the guiding surface is driven at a speed which is higher than the delivery speed of the drafting unit and higher than the withdrawal speed of the withdrawal device such that yarn outer edge fibers are detached from central yarn core regions and are accelerated to a higher speed than the central yarn core regions, and air current applying apparatus separate from the guiding element for applying an air current to the sliver at a position downstream of the drafting unit and upstream of portions of the guiding surface and of the at least one false-twisting nozzle in an area where a spinning triangle is formed in the slivers with a triangle base at the outlet of the drafting unit and a triangle apex downstream thereof, said air current having a component in the transverse direction of the travel path of the sliver, whereby the air current is effective in controlling fibers in the sliver by spreading away large numbers of the fiber ends from the fiber core of the sliver before the sliver experiences substantial twisting caused by the at least one false-twisting nozzle.

23. An arrangement according to claim 22, wherein the air current has a component perpendicular to the spinning triangle formed by the sliver when leaving the pair of delivery rollers of the drafting unit.

24. An arrangement according to claim 22, wherein the air current has a component in the travelling direction of the sliver.

25. An arrangement according to claim 24, wherein the guiding element facilitates weakening the false twist extending from the false-twisting nozzle back to the drafting unit.

26. An arrangement according to claim 25, wherein the guiding element facilitates placing spread-away fiber ends against the sliver rotating with a false twist around its longitudinal axis.

27. An arrangement according to claim 22, wherein the guiding element facilitates weakening the false twist extending from the false-twisting nozzle back to the drafting unit.

28. An arrangement according to claim 22, wherein the guiding element facilitates placing spread-away fiber ends against the sliver rotating with a false twist around its longitudinal axis.

29. An arrangement according to claim 28, wherein the guiding element has a perforation and, on its side facing away from the sliver is provided with a suction insert.

30. An arrangement according to claim 29, wherein the suction insert is directed with an intake opening to the sliver and to the area of the pair of delivery rollers of the drafting unit.

31. An arrangement according to claim 29, wherein the perforation, at least in the area facing the drafting unit, is arranged laterally offset next to a closed guiding surface portion of the guiding surface.

32. An arrangement according to claim 31, wherein a guiding element is provided between the closed guiding surface and the perforation and for guiding the sliver laterally.

33. An arrangement according to claim 28, wherein the guiding surface is arranged offset to a linear connection between the outlet of the drafting unit and an inlet to the false-twisting nozzle.

34. An arrangement according to claim 22, wherein the guiding surface is a cylindrical surface, the axis of which extends essentially in parallel to axes of a pair of delivery rollers of the drafting unit.

35. An arrangement according to claim 22 wherein at least one of air guiding elements and air current generating elements are arranged in the area of a pair of delivery rollers of the drafting unit.

36. An arrangement for false-twist spinning comprising:

a drafting unit for drafting sliver, at least one false-twisting device arranged downstream of the drafting unit for false-twisting sliver to form a yarn, a withdrawal device arranged downstream of the at least one false-twisting device, a guiding element which is arranged between the drafting unit and the false-twisting nozzle, said guiding element being driven to perform rotations around an axis disposed transversely with respect to the yarn travelling direction, said guiding element forming a deflection with a yarn guiding surface moving in the travelling direction of the yarn and configured to cause relative sliding movement of the yarn on the yarn guiding surface, wherein the guiding surface is driven at a speed which is higher than the delivery speed of the drafting unit and higher than the withdrawal speed of the withdrawal device such that yarn outer edge fibers are detached from central yarn core regions and are accelerated to a higher speed than the central yarn core regions, and air current applying apparatus separate from the guiding element for applying an air current to the sliver at a position downstream of the drafting unit and upstream of portions of the guiding surface and of the at least one false-twisting nozzle in an area where a spinning triangle is formed in the slivers with a triangle base at the outlet of the drafting unit and a triangle apex downstream thereof, said air current having a component in the transverse direction of the travel path of the sliver, whereby the air current is effective in controlling fibers in the sliver by spreading away large numbers of the fiber ends from the fiber core of the sliver before the sliver experiences substantial twisting caused by the at least one false-twisting nozzle.

37. A process for manufacturing spun yarn comprising:

drafting sliver in a drafting unit, false twisting the sliver in at least one false twisting device arranged downstream of the drafting unit to form a yarn, withdrawing the yarn via a withdrawal device arranged downstream of the at least one false-twisting device, applying guide forces to the yarn via a guiding element which is arranged between the drafting unit and the false-twisting device, said guiding element being driven to perform rotations around an axis disposed transversely with respect to the yarn travelling direction, said guiding element forming a deflection with a yarn guiding surface moving in the travelling direction of the yarn and configured to cause relative sliding movement of the yarn on the yarn guiding surface, wherein the guiding surface is driven at a speed which is higher than the delivery speed of the drafting unit and higher than the withdrawal speed of the withdrawal device such that yarn outer edge fibers are detached from central yarn core regions and are accelerated to a higher speed than the central yarn core regions, and applying an air current to the sliver at a position downstream of the drafting unit and upstream of portions of the guiding surface and of the at least one false-twisting nozzle in an area where a spinning triangle is formed in the slivers with a triangle base at the outlet of the drafting unit and a triangle apex downstream thereof, said air current having a component in the transverse direction of the travel path of the sliver, whereby the air current is effective in controlling fibers in the sliver by spreading away large numbers of the fiber ends from the fiber core of the sliver before the sliver experiences substantial twisting caused by the at least one false-twisting nozzle.

* * * * *